US005503198A

United States Patent [19]

Becker

[11] Patent Number: 5,503,198

[45] Date of Patent: Apr. 2, 1996

[54] METHOD AND APPARATUS FOR FILLING CONTAINERS WITH DRY ICE PELLETS

[76] Inventor: James R. Becker, 2140 Scranton Rd., Cleveland, Ohio 44113

[21] Appl. No.: 324,023

[22] Filed: Oct. 14, 1994

[51] Int. Cl.[6] ..... B65B 1/08; B65B 1/16

[52] U.S. Cl. ..... 141/67; 141/59; 141/70; 141/285; 406/56; 406/168; 406/24; 222/131

[58] Field of Search ..... 141/47, 54, 59, 141/67, 69, 70, 387–389, 285, 290; 406/54, 56, 61, 108, 122, 144, 164, 168, 173, 175, 24, 32; 222/183, 131

[56] References Cited

U.S. PATENT DOCUMENTS

| | | | |
|---|---|---|---|
| 3,301,441 | 1/1967 | Werner et al. | 222/131 |
| 4,389,820 | 6/1983 | Fong et al. | 51/410 |
| 4,593,835 | 6/1986 | Kikkawa et al. | 222/183 |
| 4,617,064 | 10/1986 | Moore | 51/165.73 |
| 4,900,200 | 2/1990 | Harumoto et al. | 406/122 |
| 5,178,496 | 1/1993 | Trieb et al. | 406/173 |
| 5,184,427 | 2/1993 | Armstrong | 134/7 |

OTHER PUBLICATIONS

Sales Brochure, "Cryogenesis Model 1350–1", (12 pages), no date available.

*Primary Examiner*—Henry J. Recla
*Assistant Examiner*—Steven O. Douglas
*Attorney, Agent, or Firm*—Fay, Shapre, Beall, Fagan, Minnich & McKee

[57] ABSTRACT

A pneumatic pellet transportation apparatus loads a predetermined quantity of dry ice pellets into an empty container while simultaneously evacuating the containers of dead air. The apparatus includes an aerator for fluidizing the dry ice pellets into a moving stream of compressed air. A container interface unit directs the fluidized dry ice pellets into an opening provided in the container. A method of using the pneumatic pellet transportation apparatus includes deactivating an auger well before the aerator is deactivated in order to clear the vacuum insulated transport conduit for efficient utilization of dry ice pellet resources.

14 Claims, 7 Drawing Sheets

METHOD AND APPARATUS FOR FILLING CONTAINERS WITH DRY ICE PELLETS

BACKGROUND OF THE INVENTION

This application pertains to the art of bulk loading and more particularly to filling empty containers with pelletized solids through a small hole provided in the container. Further, the application pertains to methods and apparatus for rapidly filling containers with dry ice pellets. The invention is specifically applicable to filling cold food storage containers such as used in connection with the transportation of food products where the cold-filled containers are used to maintain the food products at a reduced temperature to prevent spoilage during shipment.

Recent trends in Europe and other countries throughout the world have created a demand for an efficient mechanism whereby food products that are transported over great distances are maintained at or below an established temperature to greatly eliminate the spoilage process. One such method is to transport the food products in tractor trailers or railway box cars together with ice or carbon dioxide blocks, the latter most commonly in the form of dry ice pellets. In practice, the pelletized carbon dioxide, typically the size of rice grains, is placed within a plurality of rectangular easy-to-handle and stackable containers. The filled boxes are interlaced between the food products packed in a cargo box. The dry ice pellets absorb the heat within the cargo box and establish and maintain a reduced temperature of the food products in accordance with the applicable laws, customs and practice.

After the food products have reached their intended destination, the dry ice pellet containers are emptied, cleaned and refilled with fresh dry ice pellets for reuse in connection with the transportation of additional food products.

When a large number of dry ice pellet containers are involved, one significant limitation in the transportation process becomes the efficient filling of those containers with fresh dry ice pellets. Therefore, it is desirable that a method and apparatus be provided for filling a large number of containers with dry ice pellets in a manner that does not significantly impede but rather expedites the fresh food shipment process.

It is desirable that the apparatus be automated to uniformly fill a plurality of substantially identically sized dry ice containers substantially one after another. Prior art methods, including hand-filling of the containers, are very inefficient and labor intensive.

SUMMARY OF THE INVENTION

The present invention contemplates new and improved methods and apparatus for filling containers with dry ice pellets that overcome the above-referenced problems and provide fresh food shippers with the ability to load empty containers with a desired amount of dry ice pellets from a bulk supply quickly and efficiently.

Although the invention will be described below in connection with dry ice pellets, the invention has other uses and is readily extendable to other material-packing or -filling situations. Those skilled in the art will recognize that the invention finds application with any product that is amenable to being fluidized by a fast moving air stream such as sand, powder or the like.

According to the preferred embodiment of the present invention, a dry ice pellet filling apparatus fluidizes dry ice pellets in a moving airstream as a mixture. The mixture is directed into the opening of a dry ice pellet container. The apparatus thus operates as a pneumatic pellet transport device.

According to a more limited aspect of the invention, the apparatus includes an aerator or fluidizer that is connected to a bulk source of pellets through a pellet-feeding mechanism. The aerator is in turn connected to an input end of a transport conduit, which containedly directs the fluidized dry ice pellets toward the opening in an empty dry ice container at an operator's station. A container interface unit fashioned to resemble and operate much like a gun is also provided at the operator's station for interfacing the output end of the transport conduit with the opening in the dry ice container.

According to another aspect of the invention, electronic control means for controlling the apparatus to automatically load a predetermined quantity of dry ice pellets into the empty container is provided. The automatic loading control means monitors the amount of dry ice pellets removed from the bulk pellet source and operates the feeding mechanism, aerator, and a scavenging vortex unit accordingly.

According to yet another aspect of the invention, the automatic loading control means is responsive to a manually operable electric trigger on the container interface unit. The trigger generates a signal to which the automatic loading control means responds for delivering a predetermined quantity of dry ice pellets from the bulk source into the empty container. According to a still further aspect of the invention, the bulk pellet source includes an automatic weigh station, which generates a weight signal output used by the automatic loading electronic control to determine a quantity of pellets removed from the bulk source and injected into the empty container through the feeding mechanism, aerator and transporter conduit.

According to yet a still further aspect of the invention, a method of using the pneumatic pellet transport apparatus includes generating a signal to stop the operation of the pellet feeding mechanism when the desired quantity of pellets has been transported, or upon the occurrence of some other event such as an emergency step situation, and simultaneously starting a count down timer. At the expiration of the count down timer, the aerator is turned off. The continued operation of the aerator during the delay defined by the count value ensures that all residual dry ice pellets fed from the bulk source are cleared from the transport conduit and container interface unit.

According to yet another further aspect of the invention, a vortex unit creates a low pressure source at the interface unit which is advantageously used to simultaneously evacuate or otherwise scavenge the air displaced by the dry ice pellets filling the container.

A primary advantage of the invention resides in its ability to quickly, efficiently and uniformly load empty dry ice containers with pelletized carbon dioxide pellets automatically.

Another advantage of the invention is found in the convenient configuration of the apparatus including the pistol grip container interface unit at the operator's station for interfacing the transport conduit with the plurality of dry ice containers. The unit is easy to use and the conduit and interface unit is further supported overhead to reduce the stress and strain placed on the operator.

Another advantage of the invention is presented in the convenient overall arrangement of the components comprising the apparatus, including the bulk pellet source that is substantially spaced apart from the operator's station. The bulk pellet source includes a gravity feed hopper that is maintained in a full condition substantially independent of the empty container filling process. A vibrator at the hopper operates when needed to break apart agglomerated pellets.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred and alternative embodiments of which will be described in detail in this specification and illustrated in the accompanying drawings, which form a part hereof and wherein.

DETAILED DESCRIPTION OF THE PREFERRED AND ALTERNATIVE EMBODIMENTS

Figure 1:
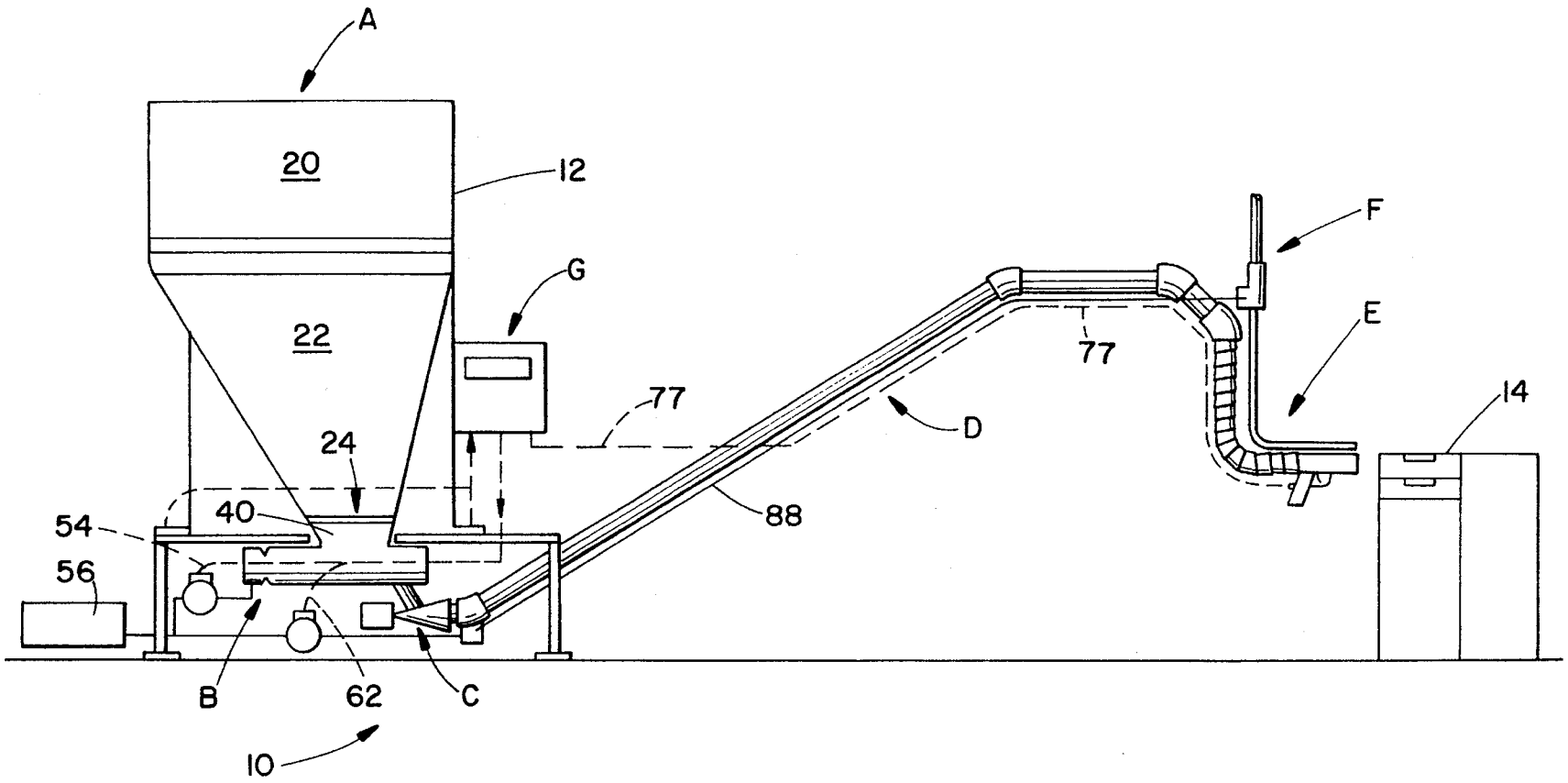
FIG. 1 is a schematic view of the subject invention showing a pneumatic pellet transportation apparatus ready to load a plurality of stacked empty dry ice containers.

Referring now to the drawings wherein showings are for purposes of illustrating the preferred and alternative embodiments of the invention only and not for purposes of limiting same, the FIGURES show a pneumatic pellet transportation apparatus 10 including a bulk pellet source A feeding an aerator C through a pellet feeding mechanism B. The fluidized dry ice pellets are directed to a container interface unit E through a transport conduit D. A vortex unit F is connected to the container interface unit for purging or otherwise extracting dead or stagnate air from the containers while they are being filled with dry ice pellets. An electronic controller G supervises the entire operation.

With reference first to FIG. 1, the pneumatic pellet transportation apparatus 10 stores dry ice pellets in the bulk pellet source A which includes a vacuum insulated gravity fed storage hopper 12. The dry ice pellets travel through the system from the storage hopper to the empty containers 14 under the direction and control of the electronic controller G. The pellet feeding mechanism B selectively delivers dry ice pellets at a predetermined rate to the aerator C, at which point the dry ice pellets are fluidized with a stream of high-pressure air. The fluidized pellets traverse the transport conduit D, which in the preferred embodiment extends for thirty feet at a slight incline as illustrated. The dry ice pellet mixture is injected into the empty containers 14 through a container interface unit E, which is fashioned to resemble and operate much like a pistol. The dead air within the containers is evacuated simultaneous with the injection of the dry ice pellets by means of the vortex unit F, which creates a negative pressure differential at the container interface tool E. Thus, the air displaced by the pellets filling the containers is removed by the vortex unit, preventing a build up of pressure within the containers that would otherwise impede the filling process.

Figure 2:
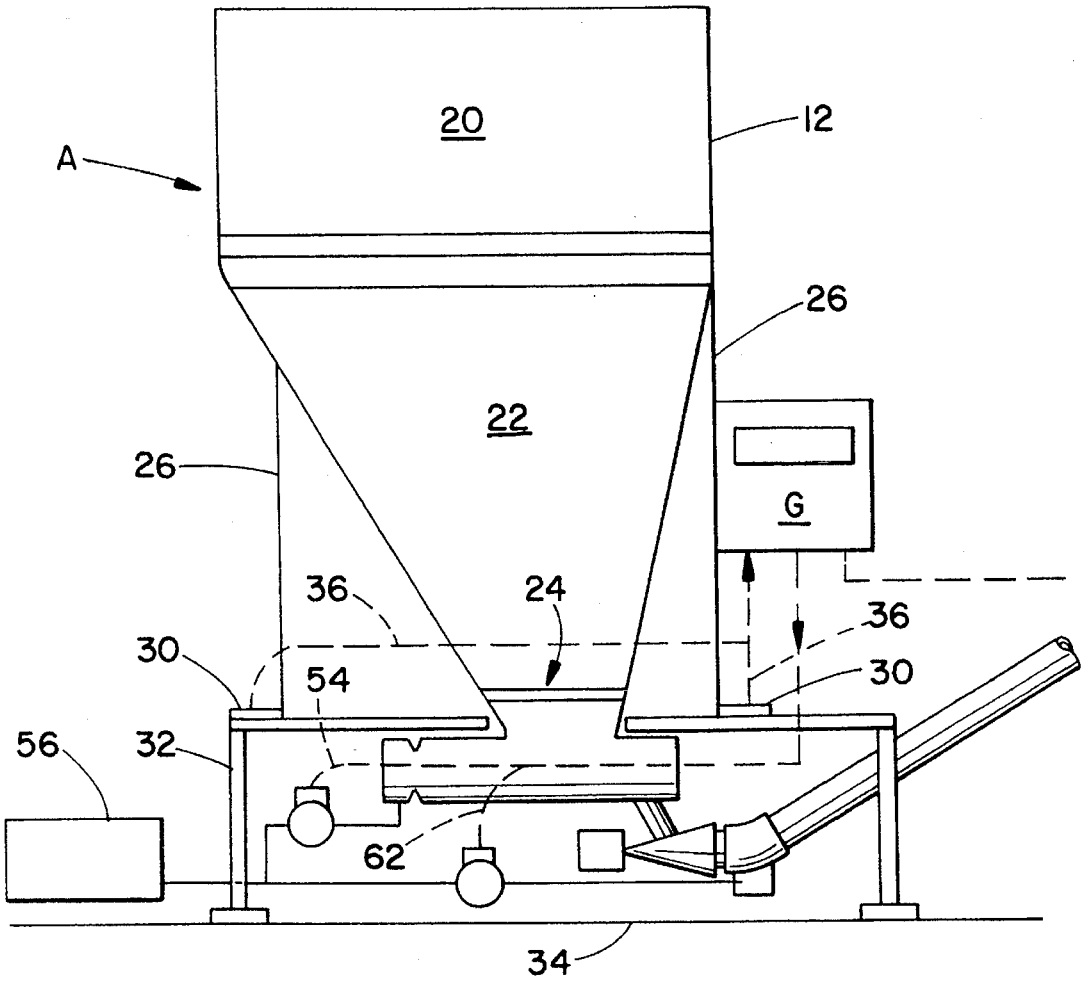
FIG. 2 is a schematic view of the bulk dry ice pellet source illustrated in FIG. 1.

With continued reference to FIG. 1 but with further reference to FIG. 2, the pellet source A will be described in greater detail. The pellet source A includes a stainless steel storage hopper 12, which is substantially rectangular in cross-section and includes a square storage region 20 disposed above a squared off tapered section 22. The tapered section 22 directs the carbon dioxide pellets within the storage hopper 12 toward a bottom open end 24 of the hopper. The hopper 12 is supported by a pair of legs 26 which are positioned upon a pair of electronic weight sensors 30. The weight sensors 30 are situated on a ruggedized stand 32 that in the preferred embodiment, positions the open end 24 of the hopper about two to three feet above the floor 34.

The pair of electronic weight sensors 30 generate an electronic weight signal 36 for use by the electronic controller G in a manner described in greater below. The sensors found to be best suited for use in the preferred embodiment illustrated are commercially available from and commonly known as a "load cell".

Generally, however, the electronic weight signal 36 is an analog or digital voltage signal that assumes a level proportional to the amount of dry ice pellets contained within the storage hopper 12. In the preferred embodiment, the storage hopper holds between fifty and sixty cubic feet of dry ice pellets. The dry ice pellets are about the size of a grain of rice, e.g., 0.125–0.200 inches diameter and 0.250–0.500 inches long. Given the average density of frozen carbon dioxide, the storage hopper can hold up to two thousand pounds of dry ice.

Figure 3:
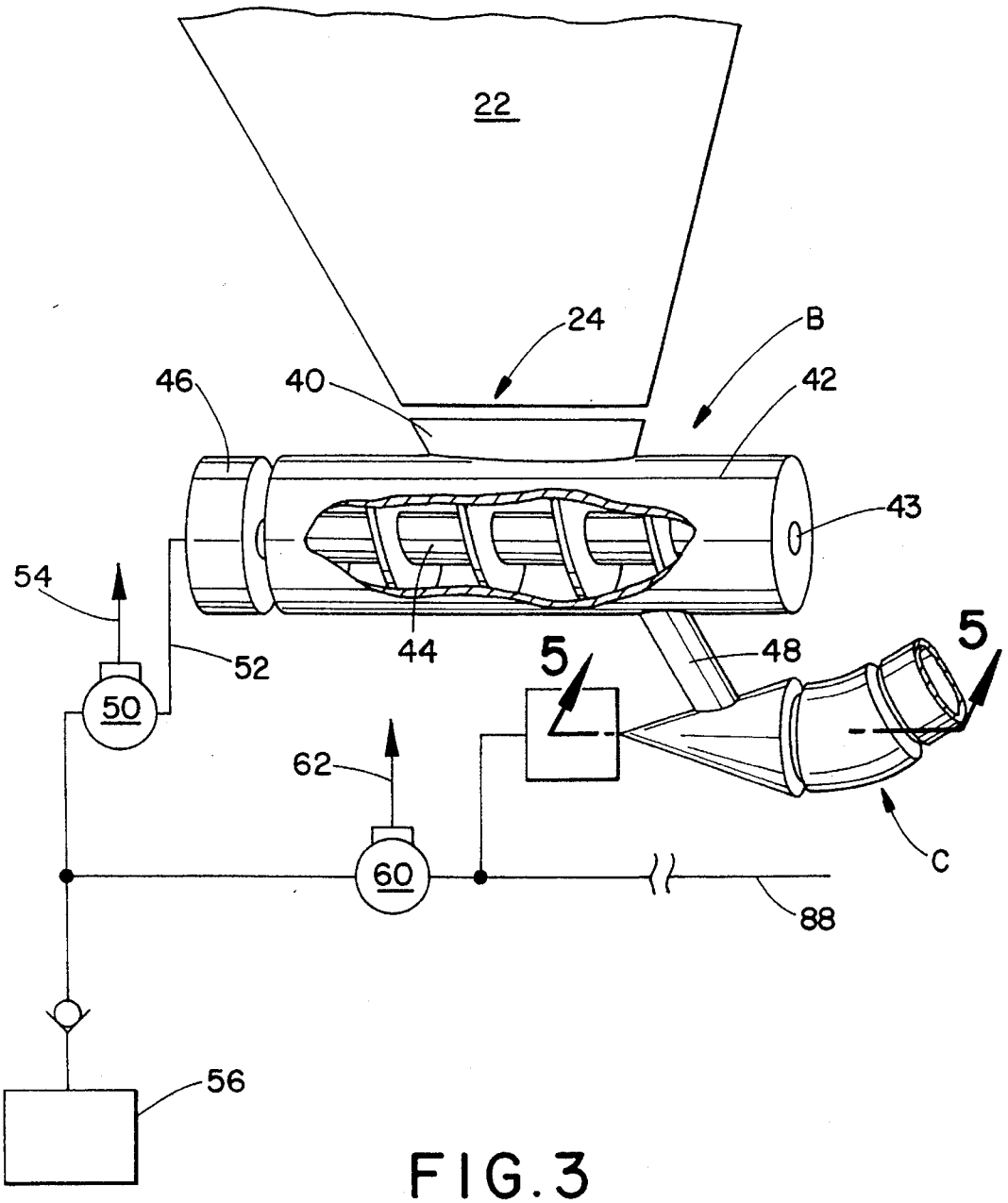
FIG. 3 is a schematic view of the pellet feeding mechanism and aerator of the apparatus illustrated in FIG. 1.

With continued reference to FIG. 1 but now in combination with FIG. 3, the bottom portion 24 of the hopper 12 is adapted to engage the pellet feeding mechanism B at an input shoot 40 thereof. The input shoot is tapered to matingly correspond with the bottom portion 24 of the hopper 12. Functionally, the input shoot 40 directs the pelletized carbon dioxide into a housing 42 of the pellet feeding mechanism B. The housing 42 contains an auger 44, which is rotatably motivated by a pneumatic motor 46. Further, the housing 42 is vented to atmosphere through an opening 43. The rotation of the auger 44 drives pellets from the shoot 40 into an output duct 48 and into the aerator C. The pneumatic motor 46 is connected to a first air valve 50 via an air conduit 52. The first air valve 50 is controlled electronically via a signal line 54 from the electronic controller G in a manner to be described in greater detail below. In general, however, the first air valve 50 operates in one of either an opened or closed position, whereby pressurized air from an operatively associated external source of pressurized air 56 is connected to the pneumatic motor 46 according to the state of the signal 54 from the electronic controller.

When the auger 44 is motivated to rotate by the pneumatic motor 46, the dry ice pellets are removed from the guide shoot 40 and dispatched to the duct 48 at a predetermined rate. The duct in turn feeds the pellets to the input side of the aerator C.

The aerator C is connected to the operatively associated external source of compressed air 56 via a second air valve 60, which operates in one of an open or closed position. The second air valve 60 is responsive to commands from the electronic controller G via a signal line 62. When the second air valve 60 is in the opened position, the aerator C is energized whereby a venturi effect is created therein to fluidize the pellets falling into the aerator from the shoot 48. The fluidized pellets are propelled into the transport conduit D which, in the preferred embodiment is a vacuum insulated one and one half inch stainless steel rigid line.

Figure 4:
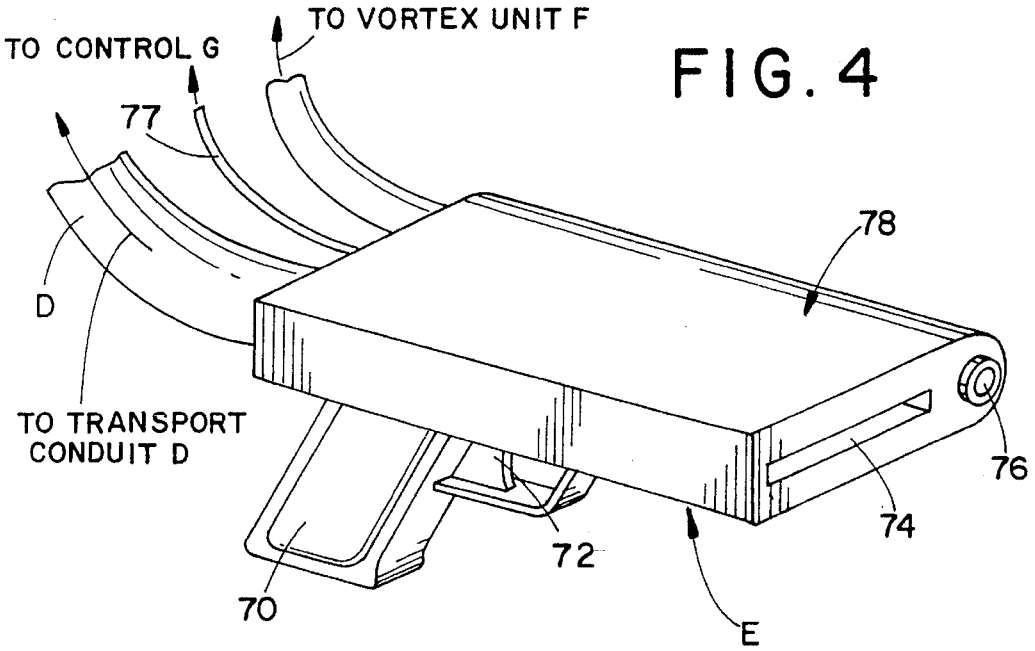
FIG. 4 is a schematic view of the container interface unit and vortex unit of the apparatus illustrated in FIG. 1.

With reference next to FIG. 4 in combination with FIG. 1, the container interface unit E is illustrated in detail and includes a handle portion 70 and a trigger 72. The trigger 72 includes a contact switch (not shown) for closing a contact at the interface unit E, whereby the electronic controller G recognizes a signal on signal line 77 and commences a procedure to fill one of the plurality of empty containers 14 according to methods set forth in greater detail below. The container interface unit E further includes a pair of openings 74 and 76 provided in an interface head 78, which is adapted to matingly engage a corresponding opening in any of the plurality of empty containers 14. The head 78 is substantially squared off and, according to the preferred embodiment, is approximately eight to ten centimeters wide and three centimeters in height.

The first opening 74 on the interface head is a container fill opening whereby the fluidized dry ice pellets travelling through the transport conduit D are directed through the container interface unit E into the opening of the empty containers 14. The second aperture 76 in the container interface unit E is an evacuation port for withdrawing or otherwise removing the dead air from within the empty containers while they are simultaneously being filled with the dry ice pellets. Since the dry ice pellets occupy space within the containers, the displaced air must be efficiently withdrawn from the containers such as by the vacuum provided by the vortex unit F which will be described immediately below.

Figure 5:
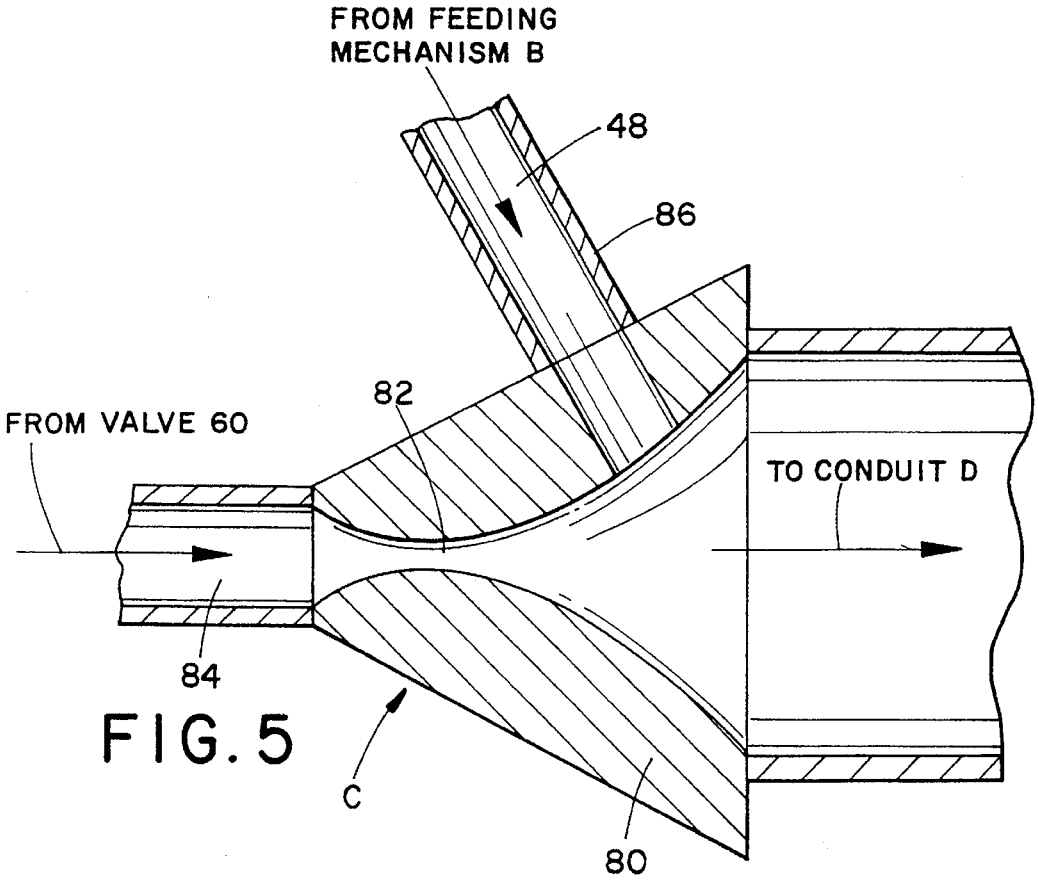
FIG. 5 is a cross-sectional view of the aerator unit illustrated in FIG. 3 taken along line 5—5.

The aerator C is best illustrated in FIG. 5 whereby a housing 80 is provided defining a venturi 82 therein. A source of high-pressure is connected to the input port 84 of the aerator C. A reduced pressure is created within the housing 94 which is in turn transmitted to the feeding mechanism B via the duct 48. In the preferred embodiment, the aerator C is available from Waste Minimization and Containment Services, Inc. and include such units as their Cryogenesis® Model 20-100 unit. This commercially product typically operates at twenty pounds of pressure on the input side and outputs one hundred cfm. on the output side. The draw is two hundred cfm. at the duct 48.

The input port 84 receives the pressurized air from the source 56 in a manner best illustrated in FIGS. 1 and 3. More particularly, the input port 84 receives the pressurized air from the valve 60 through the conduit 88. When the valve 60 is in an open position, the aerator C operates using the venturi principle.

Figure 6:
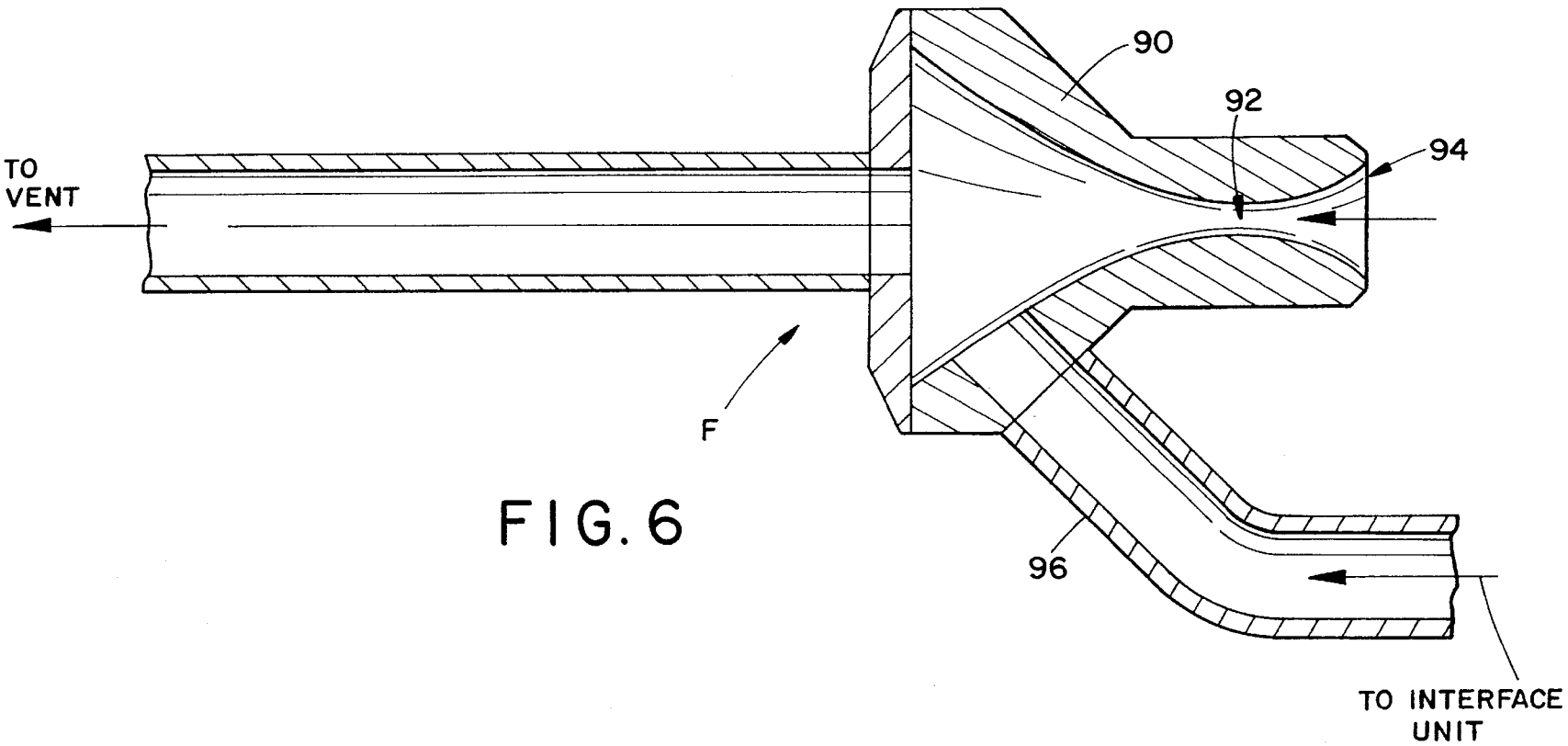
FIG. 6 is a cross-sectional view of the vortex unit illustrated in FIG. 1 taken along line 6—6.

The vortex unit F is best illustrated in FIG. 6 whereby a housing 90 is provided defining a venturi 92 therein. A source of high pressure moving fluid is connected to the input port 94 of the vortex unit F. A reduced pressure is created within the housing 94 which is turn transmitted to the container interface unit E via a flexible conduit 96.

The input port 94 receives the pressurized air from the source 56 in a manner best illustrated in FIGS. 1 and 3. More particularly, a fluid conduit 99 is provided between the air valve 60 and the vortex unit F. Accordingly, when the valve 60 is in an open position, both the aerator C and the vortex unit F operate. Correspondingly, both cease to operate when the valve 60 is closed in response to the signal 62 from control G.

Figure 7:
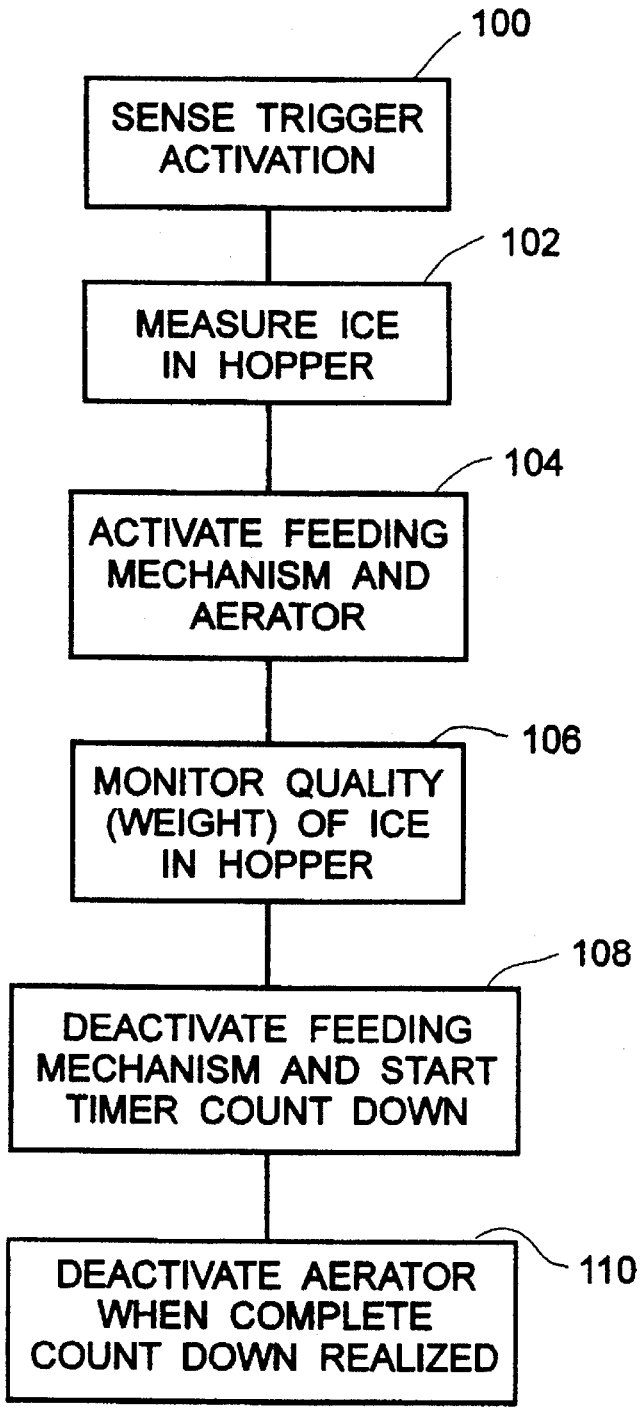
FIG. 7 is a flow chart illustrating a preferred method of operating the apparatus illustrated in FIG. 1; and, FIG. 8 is an alternative embodiment of the bulk pellet source illustrated in FIG. 2.

The preferred method of using the apparatus illustrated and discussed above is shown in FIG. 7. To begin, the trigger 72 is activated at step 100. Once the trigger is manipulated by the operator, a signal is transmitted to the electronic controller G via the signal line 77. The controller polls the electronic weighing devices 30 via the signal line 36 in order to determine an initial volume of dry ice within the storage hopper 12 at step 102. In the preferred embodiment, the controller is of the programmable type supplied by Fairbanks Scale.

Next, at step 104, both the first and second air valves 48, 60 are activated by the electronic controller G in order to connect both the pellet feeding mechanism B and aerator C to the operatively associated source of high pressure air 56. Once this happens, the auger 44 within the pellet feeding mechanism B is rotated by the pneumatic motor 46, which portions out pellets from the hopper 12 into the aerator C at a predetermined rate.

The dry ice pellets that are fed to the aerator are fluidized and propelled into the transport conduit D by the fast stream of moving air therethrough.

At step 106 the electronic controller continuously monitors the status of the electronic weight sensors 30 in order to determine when a predetermined quantity of pellets have been emptied from the hopper 12. The predetermined quantity q is selected to be that quantity of pellets required to fill an empty container Q less an amount r expected to remain within the transport conduit D. Thus, $q=Q-4$.

When the predetermined quantity q of pellets have been removed from the hopper as observed by the electronic controller G at step 106, the first air valve 50 is operated to an off position and thus no further pellets are fed into the aerator C. However, at this point, the aerator is permitted to remain on, step 108, for a predetermined time period in order to clear the transport conduit D of residual dry ice pellets of quantity r.

At step 110, after the predetermined time period has lapsed, the electronic controller G changes state of the signal from the second air valve 60, which completes the filling operation. As can be seen from the FIGURES, the vortex unit F operates in tandem with the aerator C such that, whenever dry ice pellets are being fed into the containers, the dead or stagnant air is simultaneously being withdrawn therefrom.

Figure 8:
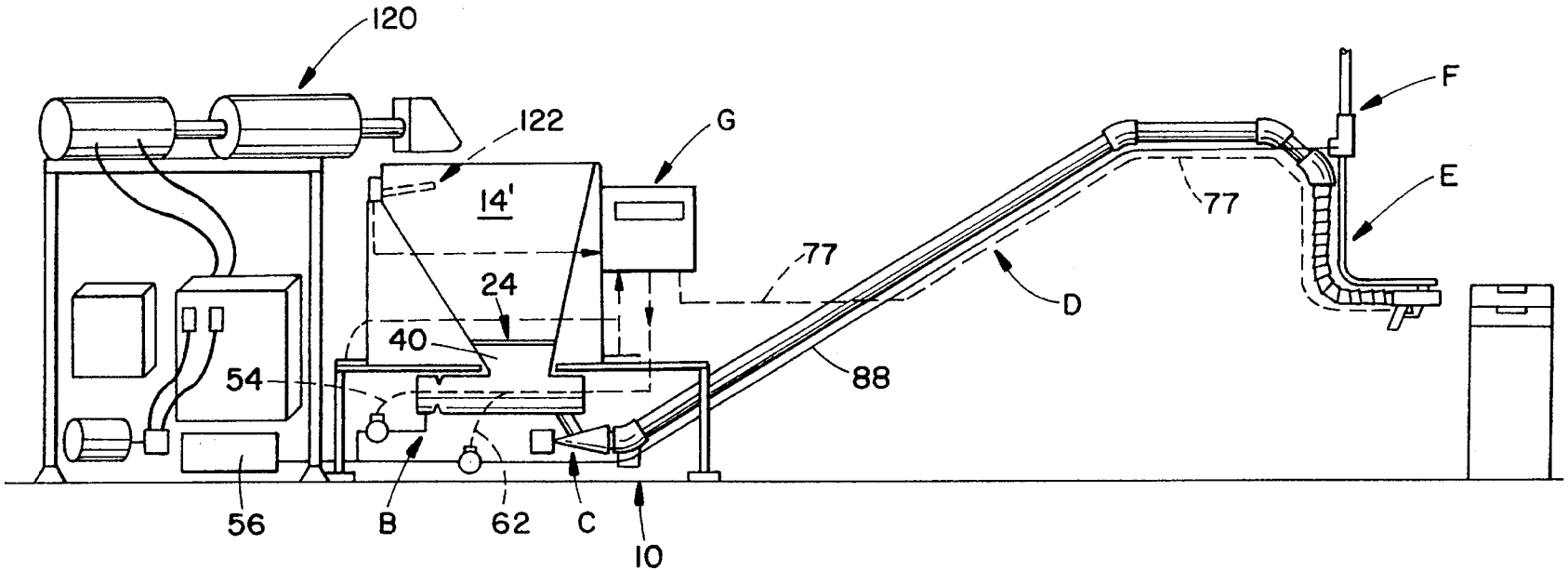

With reference now to FIG. 8, an alternative embodiment of the invention is illustrated wherein the large bulk storage hopper 12 is replaced with a dry ice pellet fabricating machine 120. In this embodiment, the dry ice pellet fabricating machine 120 produces up to 1,200 pounds of dry ice pellets per hour at a continuous rate. Such machines are available from Waste Minimization and Containment Services, Inc. and include such units as their CRYOGENESIS® Model 350 Pellelizer. A level switch 122 is activated when the continuously produced dry ice pellets in the reduced hopper 14' reach a predetermined level, at which time the electronic controller deactivates the production apparatus 120.

The invention has been described with reference to the preferred and alternative embodiments. Modification and alterations will occur to others upon reading and understanding of this specification. It is my intention to include all such modifications and alterations insofar as they come within the scope of the appended claims or equivalents thereof.

Having thus described the invention, I now claim:

1. An apparatus for filling a container with pellets comprising:

a source of pellets;

a pellet feeding mechanism receiving pellets from the source of pellets at a pellet receiving end and selectively discharging pellets from the mechanism at a pellet discharge end;

an aerator connected to the pellet discharge end of the pellet feeding mechanism for mixing the pellets from the pellet feeding mechanism with a pressurized fluid flow as a fluidized mixture;

a conduit for containedly directing the fluidized mixture from the aerator to a discharge end of the conduit; and, a container interface unit for interfacing the discharge end of the conduit with an aperture in a container, the container interface unit including a first housing having a plurality of passageways through the first housing, a first passageway of said plurality of passageways defining a fill opening between said aperture in the container and said discharge end of the conduit and a second passageway of said plurality of passageways defining an evacuate opening between said aperture in the container and a source of first pressure less than a second pressure in the container at said aperture wherein said source of pellets includes a vacuum insulated storage hopper adapted to store pelletized carbon dioxide pellets therein.

2. The apparatus according to claim 1 wherein said source of pellets further includes a weighing device supporting said vacuum insulated storage hopper, the weighing device including means for generating a weight signal representative of a quantity of pelletized carbon dioxide pellets in said storage hopper.

3. The apparatus according to claim 2 wherein said vacuum insulated storage hopper is a gravity feed storage hopper including a vibration device for imparting mechanical energy to said pelletized carbon dioxide pellets in the gravity feed storage hopper to urge the pellets towards said pellet feeding mechanism.

4. The apparatus according to claim 1 wherein said pellet feeding mechanism includes a rotatable auger in a second housing connected between said storage hopper and said aerator, the auger feeding said pelletized carbon dioxide pellets into the aerator from the hopper at a rate corresponding to the rate of rotation of the auger.

5. The apparatus according to claim 4 wherein said pellet feeding mechanism further includes a power drive mechanism for rotating said auger within said second housing, the power drive mechanism being responsive to a feed signal for controlling the rotation of the auger.

6. The apparatus according to claim 5 wherein said power drive mechanism comprises:

a pneumatic motor for rotating said auger within said second housing when supplied with a source of high pressure fluid; and, a first air valve connected between said pneumatic motor and a first operatively associated source of high pressure air, the first air valve selectively supplying said pneumatic motor with high pressure fluid from the first operatively associated source of high pressure air based on a state of said feed signal.

7. The apparatus according to claim 1 wherein said aerator comprises an aerator housing defining a venturi and a open chamber connected to the venturi, the aerator housing having a plurality of input passageways and at least one output passageway connected to an input end of said conduit, at least one input passageway of said plurality of input passageways connecting said venturi to an operatively associated source of high pressure air and at least one other of said plurality of input passageways connecting said open chamber to said pellet discharge end of the pellet feeding mechanism.

8. The apparatus according to claim 7 wherein said aerator further comprises a first air valve connected between said at least one input passageway of the aerator housing and a first operatively associated source of high pressure air, the first air valve selectively supplying said venturi with high pressure fluid from the first operatively associated source of high pressure air based on a state of a fluidize signal.

9. The apparatus according to claim 1 further comprising a vortex unit connected to said second passageway of said plurality of passageways in the container interface unit, the vortex unit including a housing defining a venturi connected to a first operatively associated source of high pressure air to generate said source of first pressure less than said second pressure in the container at said aperture.

10. The apparatus according to claim 1 further comprising an electronic controller connected to said source of pellets, said pellet feeding mechanism, said aerator, and said container interface unit, the electronic controller including:

means for receiving a weight signal representative of a quantity of pelletized carbon dioxide pellets in the storage hopper;

means for receiving a trigger signal representative of a condition of a state of a trigger device at said container interface unit;

means for generating a feed signal for use by said pellet feeding mechanism to selectively receive pellets from the source of pellets at said pellet receiving end and discharge the pellets at said pellet discharge end; and, means for generating a fluidize signal for use by said aerator to selectively mix the pellets from the pellet feeding mechanism with said pressurized fluid flow as said fluidized mixture.

11. The apparatus according to claim 10 wherein said pellet feeding mechanism includes:

a rotatable auger in a second housing connected between said storage hopper and said aerator, the auger feeding said pelletized carbon dioxide pellets into the aerator from the hopper at a rate corresponding to the rate of rotation of the auger a power drive mechanism for rotating said auger within said second housing, the power drive mechanism being responsive to said feed signal for controlling the rotation of the auger and comprising a pneumatic motor for rotating said auger within said second housing when supplied with a source of high pressure fluid; and, a first air valve connected between said pneumatic motor and a first operatively associated source of high pressure air, the first air valve selectively supplying said pneumatic motor with high pressure fluid from the first operatively associated source of high pressure air based on a state of said feed signal.

12. The apparatus according to claim 11 wherein said aerator includes:

an aerator housing defining a venturi and a open chamber connected to the venturi, the aerator housing having a plurality of input passageways and at least one output passageway connected to an input end of said conduit, at least one input passageway of said plurality of input passageways connecting said venturi to said first operatively associated source of high pressure air and at least one other of said plurality of input passageways connecting said open chamber to said pellet discharge end of the pellet feeding mechanism; and, a second air valve connected between said at least one input passageway of the aerator housing and said first operatively associated source of high pressure air, the second air valve selectively supplying said venturi with high pressure fluid from the first operatively associated source of high pressure air based on a state of said fluidize signal.

13. The apparatus according to claim 12 wherein said source of pellets includes a weighing device supporting said vacuum insulated storage hopper, the weighing device including means for generating said weight signal representative of said quantity of pelletized carbon dioxide pellets in said storage hopper.

14. The apparatus according to claim 13 wherein said electronic controller includes control means for:

generating said feed signal and said fluidize signal responsive to receiving said trigger signal;

sustaining both said feed signal and said fluidize signal for a first time period while monitoring changes in said weight signal;

deactivating said feed signal when said weight signal reaches a predetermined change level; and, after a second predetermined time period, deactivating said fluidize signal.

* * * * *